US009874160B2

(12) United States Patent
D'Amato et al.

(10) Patent No.: US 9,874,160 B2
(45) Date of Patent: Jan. 23, 2018

(54) POWERTRAIN CONTROL SYSTEM

(71) Applicant: Ford Global Technologies, LLC, Dearborn, MI (US)

(72) Inventors: Anthony Mario D'Amato, Canton, MI (US); Dimitar Petrov Filev, Novi, MI (US); Yan Wang, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 439 days.

(21) Appl. No.: 14/469,463

(22) Filed: Aug. 26, 2014

(65) Prior Publication Data

US 2015/0094939 A1 Apr. 2, 2015

Related U.S. Application Data

(60) Provisional application No. 61/883,914, filed on Sep. 27, 2013.

(51) Int. Cl.

| | |
|---|---|
| ***F02D 41/04*** | (2006.01) |
| ***F02D 28/00*** | (2006.01) |
| ***F02D 41/14*** | (2006.01) |
| ***F02D 41/24*** | (2006.01) |
| *F02P 5/15* | (2006.01) |

(Continued)

(52) U.S. Cl.

CPC ..... *F02D 28/00* (2013.01); *F02D 41/1402* (2013.01); *F02D 41/2416* (2013.01); *F02D 41/2441* (2013.01); *F02D 35/028* (2013.01); *F02D 41/0002* (2013.01); *F02D 41/2464* (2013.01); *F02D 2041/001* (2013.01); *F02D 2041/1434* (2013.01); *F02P 5/151* (2013.01)

(58) Field of Classification Search

CPC .. F02D 28/00; F02D 41/1402; F02D 41/2416; F02D 41/2441; F02D 41/2464; F02D 35/028; F02D 41/0002; F02D 2041/001; F02D 2041/1434; F02P 5/151

See application file for complete search history.

(56) References Cited

U.S. PATENT DOCUMENTS 5,839,416 A * 11/1998 Kruiswyk ..... F02B 33/42 123/559.2
6,546,329 B2 * 4/2003 Bellinger ..... B60W 30/1819 123/478

(Continued)

OTHER PUBLICATIONS

Siouris, George M., "An Engineering Approach to Optimal Control and Estimation Theory," New York: John Wiley & Sons, Inc., 1996, 425 pages.

(Continued)

*Primary Examiner* — David Hamaoui
(74) *Attorney, Agent, or Firm* — Julia Voutyras; McCoy Russell LLP

(57) ABSTRACT

Systems and methods are described for powertrain controls optimization. One method comprises adaptively learning engine settings for a sparse sample of a speed-load map, which includes engine operation at boundary conditions of a speed-load map, and generating a dynamic node look-up table based on the learned engine settings for the sparse sample. The dynamic node look-up table may provide engine settings for engine operation at speed-load points not explicitly learned during the adaptive learning.

15 Claims, 8 Drawing Sheets

(51) Int. Cl.
*F02D 35/02* (2006.01)
*F02D 41/00* (2006.01)

(56) References Cited

U.S. PATENT DOCUMENTS 7,076,360 B1 * 7/2006 Ma ..... F02D 15/04 701/103
7,263,426 B2 * 8/2007 Withrow ..... F02D 41/182 123/350
7,865,293 B2 * 1/2011 Ishizuka ..... F02D 41/40 123/486
7,980,221 B2 * 7/2011 Baur ..... B60K 6/48 123/406.23
8,116,963 B2 * 2/2012 Plambeck ..... F02D 41/2096 123/480

OTHER PUBLICATIONS

Filev, Dimitar et al., "Adaptive Control of Nonlinear MIMO Systems with Transport Delay: Conventional, Rule Based or Neural?," Institute of Electrical and Electronics Engineers, The Ninth IEEE International Conference on Fuzzy Systems, San Antonio, Texas, May 7-10, 2000, pp. 587-592, 6 pages.
Larsson, Thomas et al., "Adaptive Control of a Static Multiple Input Multiple Output System," Proceedings of the American Control Conference, Chicago, Illinois, Jun. 2000, pp. 2573-2577, 5 pages.
Filev, Dimitar et al., "Intelligent Control for Automotive Manufacturing—Rule Based Guided Adaptation," Institute of Electrical and Electronics Engineers, 26th Annual Conference of the IEEE Industrial Electronics Society, Nagoya, Aichi, Japan, Oct. 22-28, 2000, pp. 283-288, 6 pages.
Popovic, Dobrivojie et al., "Extremum Seeking Methods for Optimization of Variable Cam Timing Engine Operation," IEEE Transactions on Control Systems Technology, vol. 14, No. 3, May 2006, pp. 398-407, 10 pages.
Wong, P.K. et al., "Automotive Engine Idle Speed Control Optimzation Using Least Squares Support Vector Machine and Genetic Algorithm," International Journal of Intelligent Computing and Cybernetics, vol. 1, No. 4, 2008, pp. 598-616, 20 pages.
Ljung, Lennart, "System Identification Theory for the User," Second Edition, Upper Saddle River: Prentice Hall-PTR, 2009, relevant pp. 363-369, relevant section: "11.2 The Recursive Least-Squares Algorithm," 9 pages.
D'Amato, Anthony M. et al., "Frequency-Domain Stability Analysis of Retrospective-Cost Adaptive Control for Systems with Unknown Nonminimum-Phase Zeros," 50th IEEE Conference on Decision and Control and European Control Conference (CDC-ECC), Orlando, Florida, Dec. 12-15, 2011, 6 pages.
D'Amato, Anthony M. et al., "Adaptive Forward-Propagating Input Reconstruction for Nonminimum-Phase Systems," 2012 American Control Conference (ACC), Montreal, Canada, Jun. 27-29, 2012, pp. 598-603, 6 pages.

* cited by examiner

POWERTRAIN CONTROL SYSTEM

CROSS REFERENCE TO RELATED APPLICATIONS

The present application claims priority to U.S. Provisional Patent Application No. 61/883,914, "POWERTRAIN CONTROL SYSTEM", filed on Sep. 27, 2013, the entire contents of which are hereby incorporated by reference for all purposes.

BACKGROUND AND SUMMARY

Government regulations on fuel economy and emission standards have driven the development of engine technologies that improve engine efficiency. This technology is enabled by an increased number of actuators and more sophisticated control algorithms. As a consequence, powertrain controls steady-state optimization has increased significantly. The steady state optimization may include examining each speed-load point to determine actuator combination settings that meet predefined constraints and optimizes for fuel economy. However, identifying actuator combinations for each speed-load point may be a complex and lengthy process. As an example, extensive dynamometer data collection and post processing may be required to generate actuator settings for each speed-load point. Overall, this exercise can be prolonged, complicated, and can lead to increased costs.

The inventors herein have recognized the above issues and identified an approach to at least partly address some of the above issues. In one example approach, a method for an engine is provided comprising obtaining actuator settings for engine operation at non-boundary conditions of an engine speed-load map for which no adaptive learning is conducted via interpolation from actuator settings adaptively learned during engine operation at boundary conditions of the engine speed-load map.

In one example, an engine may be operated initially (post-manufacture) with preprogrammed settings. As engine operation continues, and boundary conditions on an engine speed-load map are encountered, engine settings for these boundary conditions may be learned. Herein, boundary conditions of the speed-load map may include one or more of minimum speed at any engine load, maximum speed at any engine load, minimum load at any engine speed, and maximum load at any engine speed, or minimum brake specific fuel consumption (BSFC). These learned engine settings may be further adapted for providing desired outputs such as improved fuel economy and reduced emissions. Additionally, these adaptively learned settings may be stored and interpolated to positions in the engine speed-load map for which no adaptive learning was previously (or will be) performed. The interpolation may be accomplished via a model of the engine rather than by using adaptive control schemes across the entire speed-load table at steady state conditions. The accuracy of the interpolation can be determined based on the points actually visited during real-time control. Therefore, rather than using adaptive control schemes across the entire engine speed-load table at steady-state (and thus requiring a visit to each speed-load point to learn data for that point), adaptively learned data at a select sub-set (e.g. boundary conditions) of the speed-load map may be either interpolated or extrapolated to positions in the map for which no adaptive learning was done, using a model of the engine.

Thus, to reduce the complexity in the context of real-time control systems which use look-up tables (LUTs), a hybrid approach for powertrain controls optimization may be utilized. The hybrid approach may combine indirect adaptive control wherein a select few points in the speed-load map (optionally only at the load boundaries) may be visited, with a parallel system identification of a dynamic node look-up table. The dynamic node look-up table may then be used in real time or offline to determine steady-state actuators settings for speed-load points not explicitly visited by the adaptive control. The actuators may include throttle, spark, and intake and exhaust cam timings (including intake valve opening timing, intake valve closing timing, exhaust valve opening timing, and exhaust valve closing timing). The optimization may be of various parameters, such as BSFC, while meeting CA50 (crank angle percentage, e.g., 50%) burn targets and load targets.

In this way, powertrain controls may be optimized without extensive data collection in real time operation. By learning adaptive actuator settings only at selected regions, e.g. at the boundaries of the speed-load map, each speed-load point on the map may not be explicitly visited for gathering data. Therefore, a significant reduction in data collection and post processing may be achieved. Further, since the modeled actuator settings for points within the boundaries of the speed-load map are based on adaptively learned settings for optimized outputs, an improvement in fuel economy and emissions may be attained. Overall, the model may enable a reduction in processing time and an improvement in fuel efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
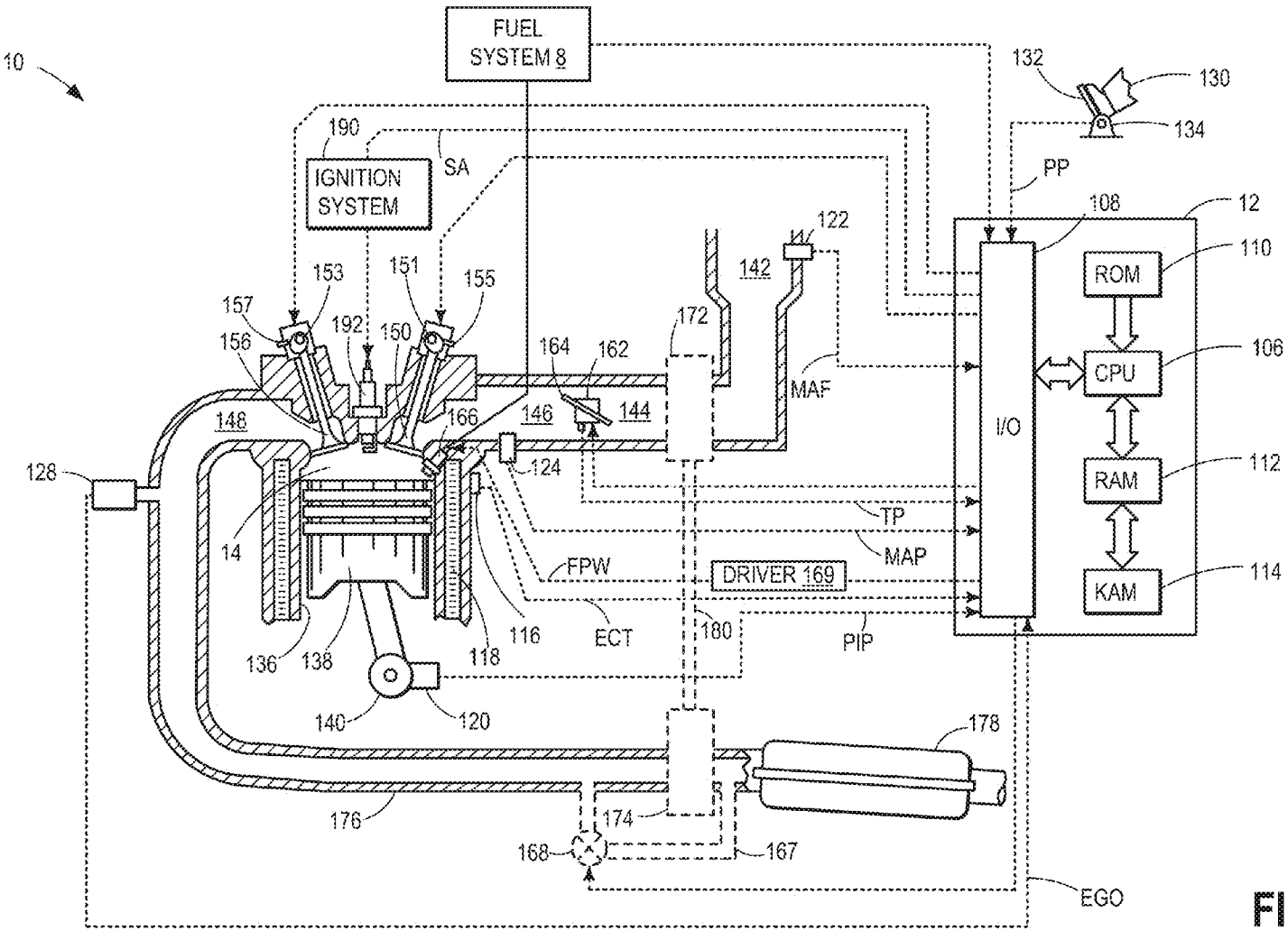
FIG. 1 is a schematic diagram of an engine system.
Figure 2:
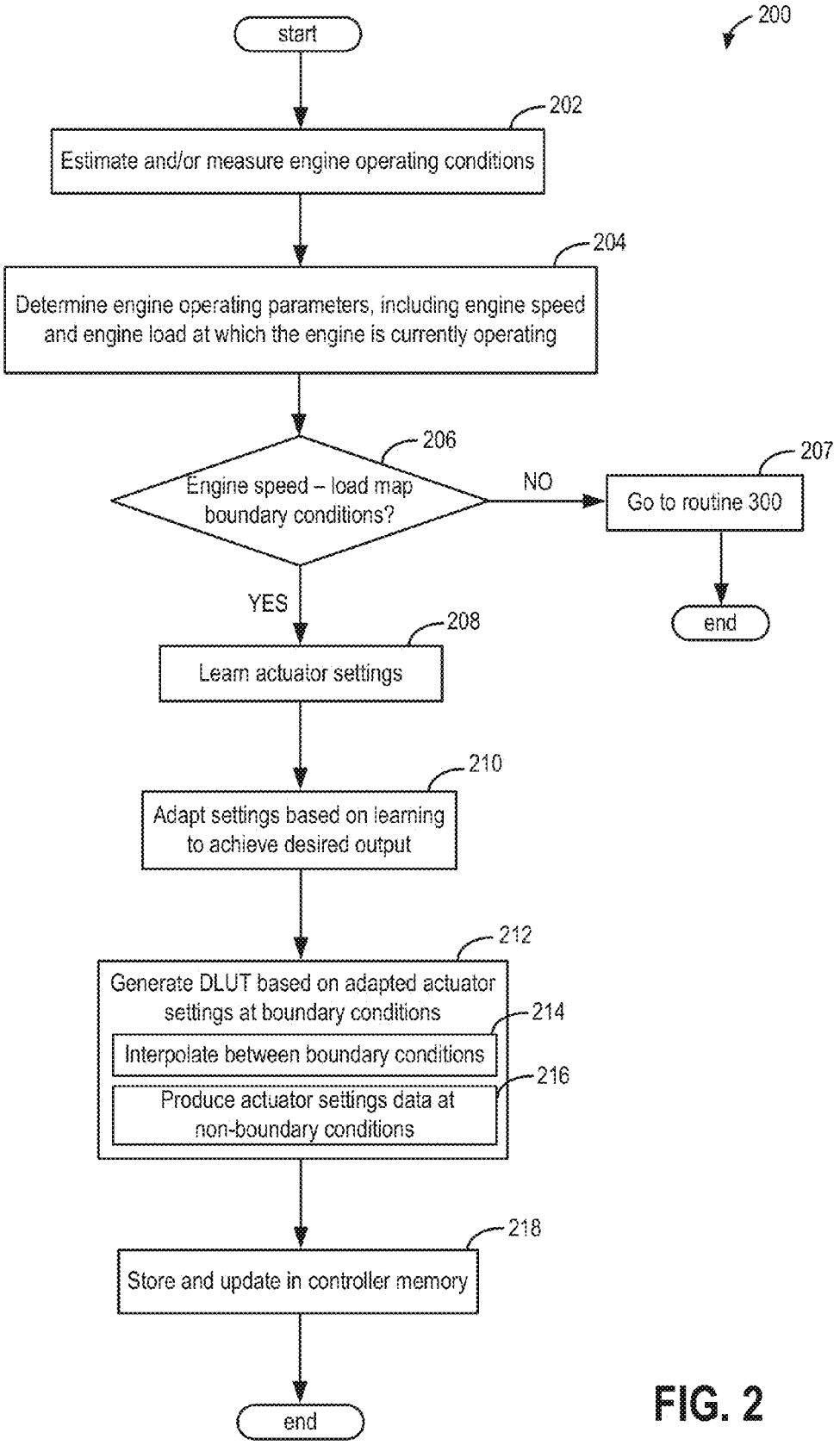
FIG. 2 depicts an example flowchart illustrating the learning of actuator settings at boundary conditions.
Figure 3:
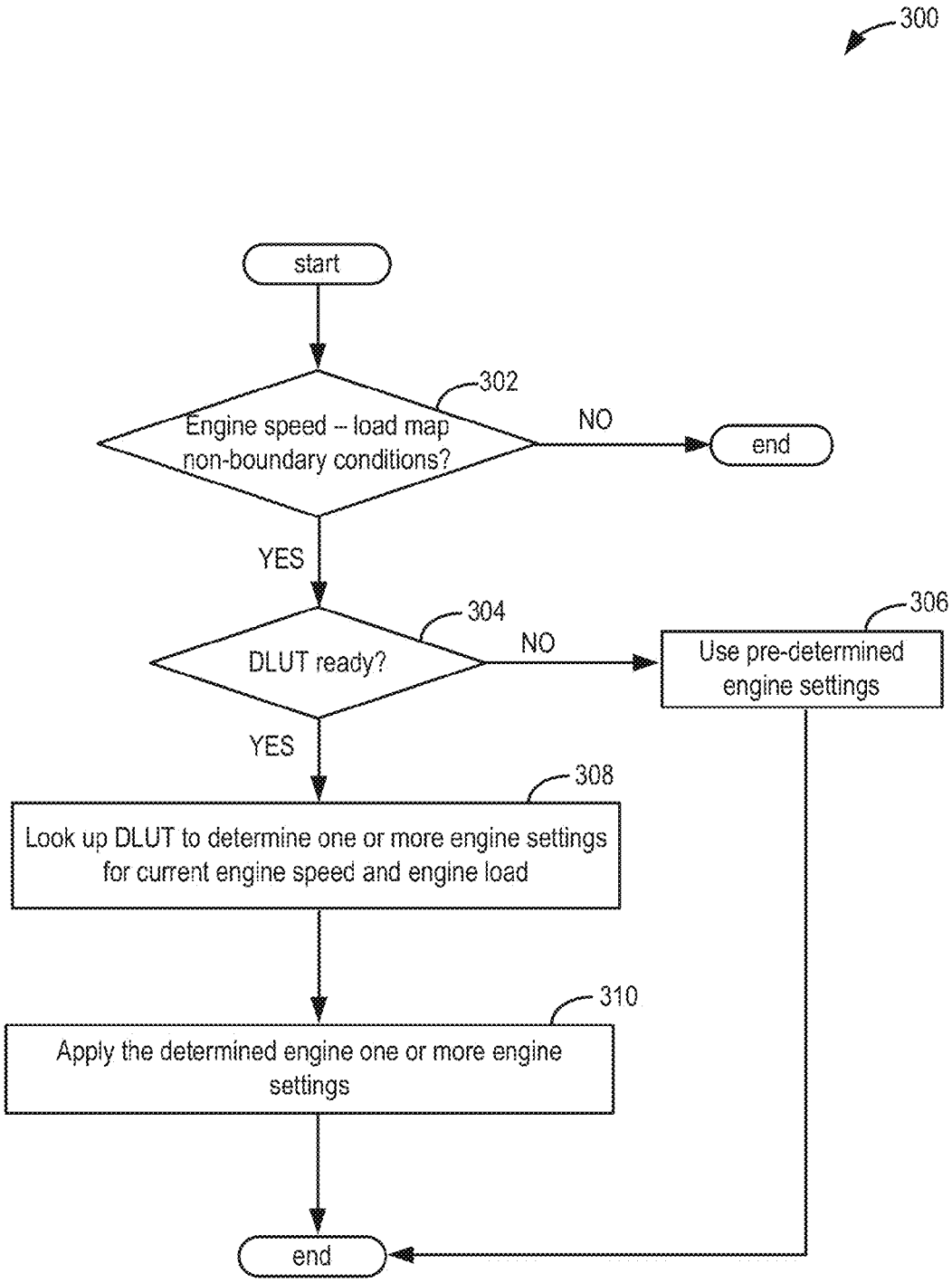
FIG. 3 portrays an example flowchart for using the dynamic node look-up table to establish actuator settings for speed-load points away from boundary conditions.
Figure 5:
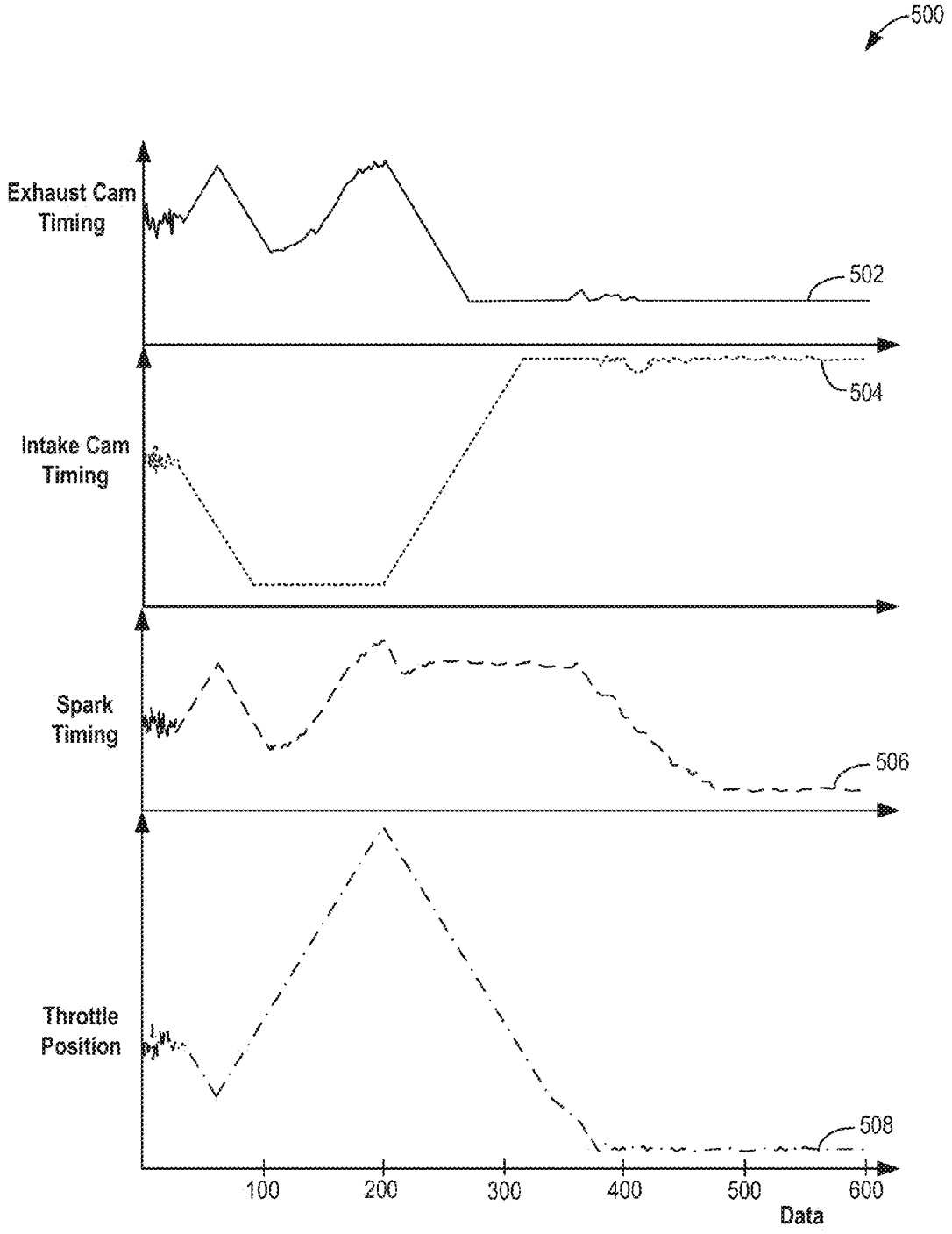
FIG. 5 shows a plot of adaptively controlled actuator settings.
Figure 6:
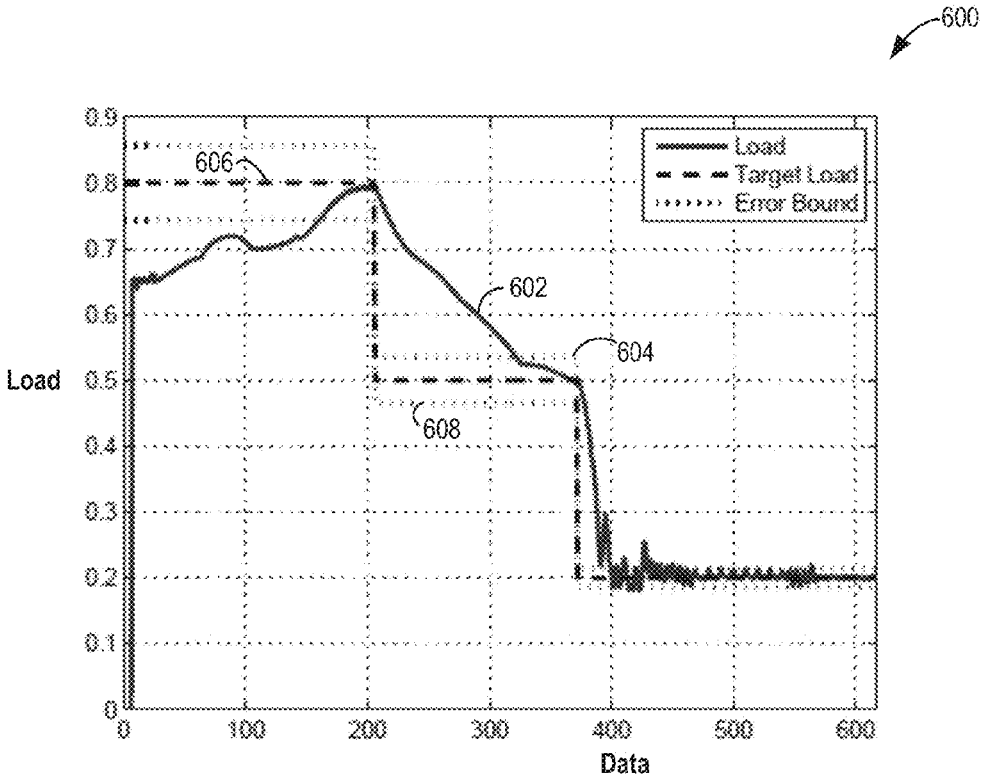
FIG. 6 depicts a variation in engine load relative to a commanded load.
Figure 7:
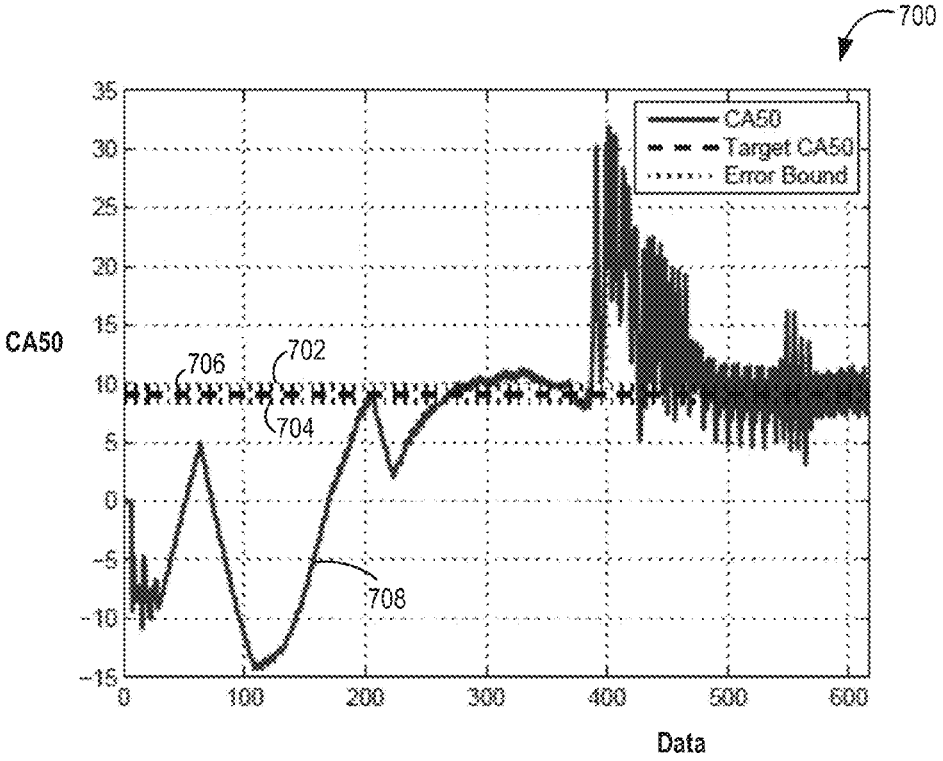
FIG. 7 illustrates a variation in CA50 relative to a commanded value.
Figure 8:
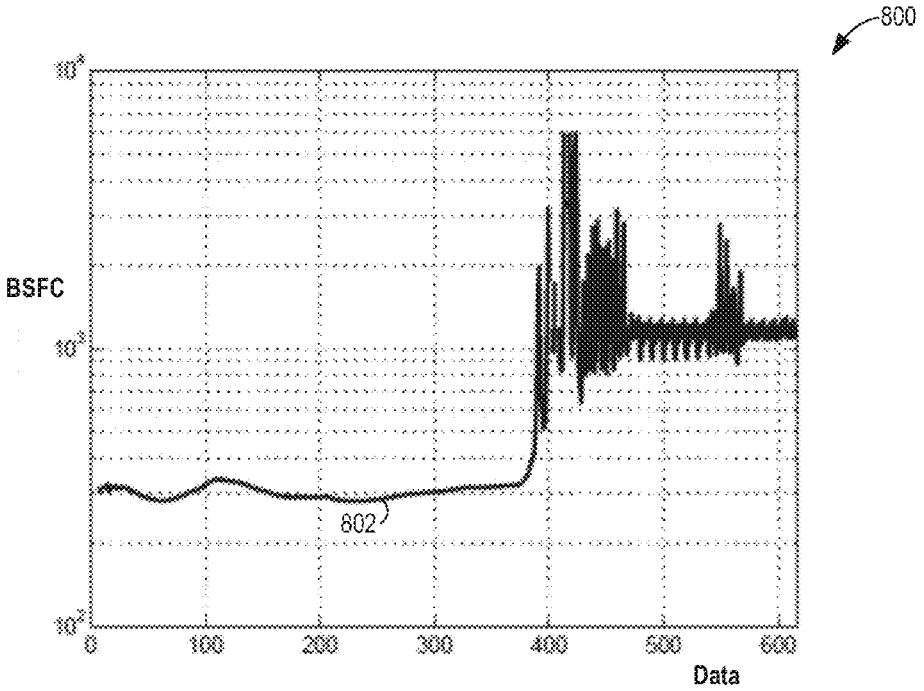
FIG. 8 portrays a variation in brake specific fuel consumption during adaptive control.
Figure 9:
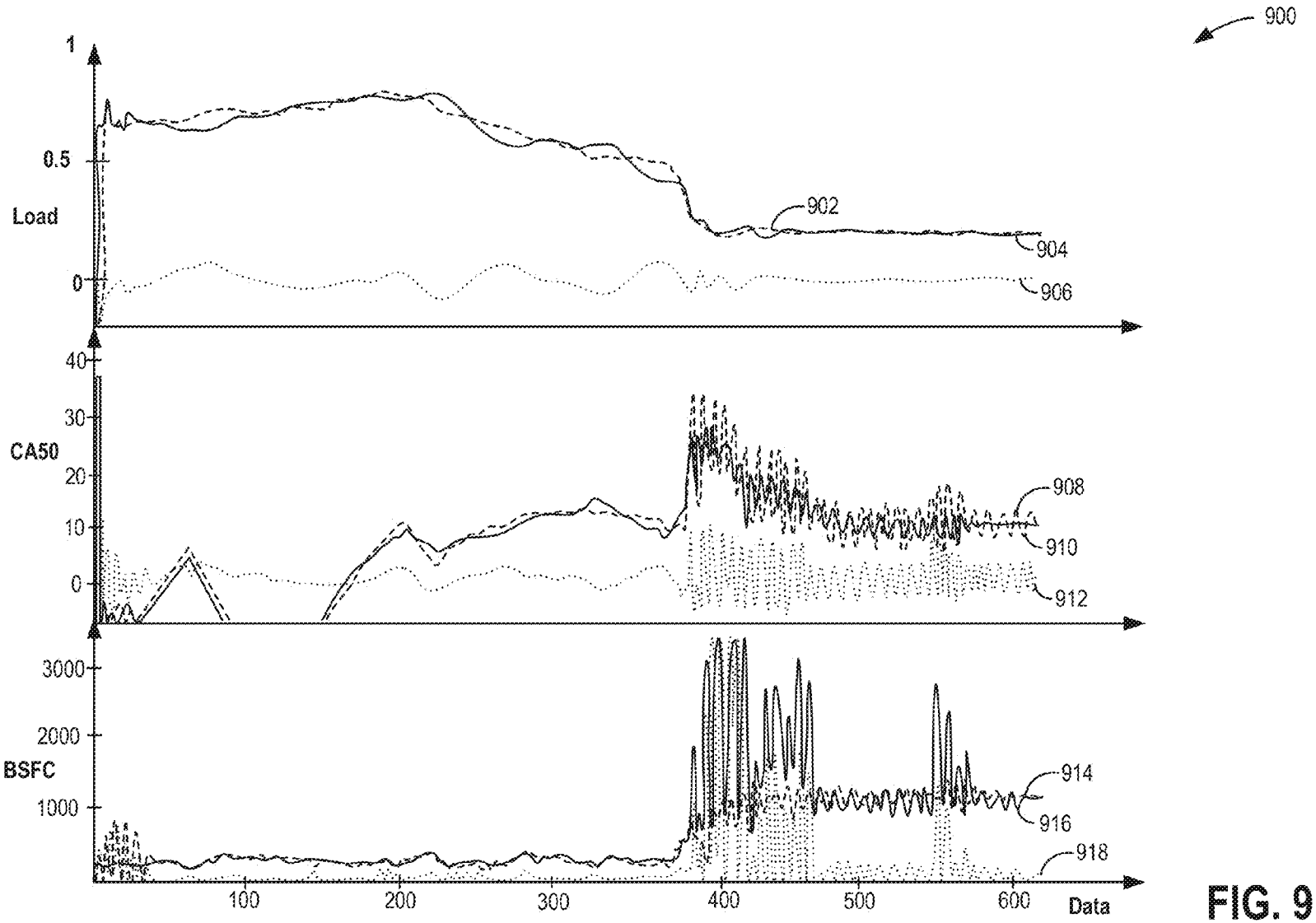
FIG. 9 is a comparison between actual engine outputs and estimated outputs based on actuator settings drawn from the dynamic node look-up table.

The following description relates to a method for learning actuator settings in an engine system, such as the engine system of FIG. 1. Actuator settings may be learned and adapted when the engine operates at boundary conditions of an engine speed-load map (FIG. 2). A dynamic node look-up table (DLUT) may be generated via an engine model in parallel to the adaptive learning of actuator settings. The DLUT may include generating actuator settings for engine conditions other than speed-load boundary conditions. Accordingly, when non-boundary conditions arise during real time engine operation, actuator settings may be determined from the DLUT (FIG. 3). In an example described in the present disclosure, an indirect adaptive control system (FIG. 4) may be used to command a selected group of conditions on the speed-load map, specifically, engine loads at the boundary of the speed-load map (FIG. 6). Actuator settings (FIG. 5) that provide the desired outputs of engine load may also be determined by the adaptive control. Further, the determined actuator settings may enable a desired output of CA50 (crank angle percentage, e.g., 50%) burn target (FIG. 7), and a desired brake specific fuel consumption (BSFC) (FIG. 8). As mentioned above, based on the actuator settings for the commanded boundary engine loads, a DLUT may be generated via point interpolation and steady-state engine settings may be estimated for non-boundary engine conditions. These estimated settings may be applied to a model of a naturally aspirated engine, and resulting outputs of parameters such as load, BSFC, and CA50 may be measured and compared with estimated outputs of the same parameters (FIG. 9).

Turning now to FIG. 1, an engine system is shown which depicts an example embodiment of a combustion chamber or cylinder of an internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder 14 (herein also "combustion chamber" 14) of engine 10 may include combustion chamber walls 136 with piston 138 positioned therein. Piston 138 may be coupled to crankshaft 140 such that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with an optional turbocharger (dashed lines) including a compressor 172 arranged between intake passages 142 and 144, and an exhaust turbine 174 arranged along exhaust passage 176. Compressor 172 may be at least partially powered by exhaust turbine 174 via a shaft 180 where the boosting device is configured as a turbocharger. However, in other examples, such as where engine 10 is provided with a supercharger, exhaust turbine 174 may be omitted, and compressor 172 may be powered by mechanical input from a motor or the engine. A wastegate 168 may be coupled across turbine 174. Specifically, wastegate 168 may be included in a bypass 167 coupled between an inlet and outlet of turbine 174. By adjusting a position of wastegate 168, an amount of boost provided by the turbine may be controlled.

A throttle 162 including a throttle plate 164 may be provided along an intake passage of the engine for varying the flow rate and/or pressure of intake air provided to the engine cylinders. For example, throttle 162 may be disposed downstream of compressor 172 as shown in FIG. 1, or alternatively may be provided upstream of compressor 172.

Exhaust manifold 148 and exhaust passage 176 may receive exhaust gases from other cylinders of engine 10 in addition to cylinder 14. Exhaust gas sensor 128 is shown coupled to exhaust manifold 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be measured by one or more temperature sensors (not shown) located in exhaust passage 176. Alternatively, exhaust temperature may be inferred based on engine operating conditions such as speed, load, air-fuel ratio (AFR), spark retard, etc. Further, exhaust temperature may be computed by one or more exhaust gas sensors 128.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system. Cam timing may be adjusted (by advancing or retarding the VCT system) based on speed/load set-points determined in accordance with the hybrid method described herein.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes.

In some embodiments, each cylinder of engine 10 may be configured with one or more injectors for providing fuel. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 169. In this manner, fuel injector 166 provides what is known as direct injection (hereafter also referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Fuel may be delivered to fuel injector 166 from a high pressure fuel system 8 including fuel tanks, fuel pumps, and a fuel rail. Fuel tanks in fuel system 8 may hold fuel.

As described above, FIG. 1 shows only one cylinder of a multi-cylinder engine. As such each cylinder may similarly include its own set of intake/exhaust valves, fuel injector(s), spark plug, etc.

While not shown, it will be appreciated that engine may further include one or more exhaust gas recirculation passages for diverting at least a portion of exhaust gas from the engine exhaust to the engine intake. As such, by recirculating some exhaust gas, an engine dilution may be affected which may improve engine performance by reducing engine knock, peak cylinder combustion temperatures and pressures, throttling losses, and NOx emissions. The one or more EGR passages may include an LP-EGR passage coupled between the engine intake upstream of the turbocharger compressor and the engine exhaust downstream of the turbine, and configured to provide low pressure (LP) EGR. The one or more EGR passages may further include an HP-EGR passage coupled between the engine intake downstream of the compressor and the engine exhaust upstream of the turbine, and configured to provide high pressure (HP) EGR. In one example, an HP-EGR flow may be provided under conditions such as the absence of boost provided by the turbocharger, while an LP-EGR flow may be provided during conditions such as in the presence of turbocharger boost and/or when an exhaust gas temperature is above a threshold. The LP-EGR flow through the LP-EGR passage may be adjusted via an LP-EGR valve while the HP-EGR flow through the HP-EGR passage may be adjusted via an HP-EGR valve (not shown).

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Storage medium read-only memory 110 can be programmed with computer readable data stored in the memory and representing instructions executable by processor 106 for performing the routines described herein as well as other variants that are anticipated but not specifically listed.

Turning now to FIG. 2, an example control routine 200 is depicted for learning actuator or engine settings at boundary conditions. Specifically, actuator settings are learned when an engine in a vehicle is operating at boundary conditions on a speed-load map. Further, the engine settings may be adjusted based on sensed values, such as engine speed and load. While speed and load are used in this example, other parameters may be used and indexed with engine speed, such as airflow, air charge, engine torque, etc. In one example, the learning and adapting process may occur during initial engine operation after vehicle manufacture. Prior to learning actuator settings that provide desired outputs under actual driving conditions on-road, the vehicle (and engine) may be preprogrammed with initial actuator settings. In another example, the engine may be operating under post-initial operation conditions. Herein, actuator settings may be learned and adapted to accommodate wear in engine parts that can affect operating parameters.

At 202, the routine includes estimating and/or measuring engine operating conditions. These may include, for example, torque demand, catalyst temperature, engine temperature, exhaust air-fuel ratio, MAP, MAF, spark timing, etc. At 204, current engine operating parameters, particularly engine speed and engine load at which the engine is currently operating, may be determined. At 206, it may be determined if the current engine speed and engine load include boundary conditions on a speed-load map. For example, boundary conditions may comprise one of a minimum speed at any engine load, a minimum load at any engine speed, a maximum speed at any engine load, and a maximum load at any engine speed, or minimum BSFC. As an example, a boundary condition may include engine operation at a minimum engine speed such as 500 rpm. In another example, engine speed may be at redline or maximum speed such as 6000 rpm.

If at 206, a boundary condition is not determined, routine 200 continues to 207. At 207, the controller may execute routine 300 of FIG. 3 to determine engine settings for engine conditions not including boundary conditions on the speed-load map. Routine 300 will be further described in reference to FIG. 3. If at 206 it is confirmed that the current engine operation is occurring at a boundary condition, routine 200 progresses to 208 to learn current actuator or engine settings. Actuator settings may include throttle position, spark timing, valve timings, EGR valve position, wastegate position, etc. Next, at 210, the learned actuator settings may be adapted to provide desired outputs. In one example, the adaptive learning may be achieved by determining actual fuel economy for a given speed-load point and adaptively adjusting the settings at this speed-load point to maximize the fuel economy and reduce BSFC. In another example, actuator settings may be adaptively adjusted to reduce emissions. In yet another example, engine torque may be determined and engine settings may be adjusted to provide improved mean brake torque (MBT).

At 212, routine 200 includes generating a dynamic node look-up table (DLUT) based on the adaptively learned actuator settings from 210. The adaptively learned values at the boundary conditions may be applied to an engine model to interpolate to other speed-load points between the boundary conditions at which no adaptive learning has yet occurred or will occur. In one example, the DLUT may be generated by a collection of linear models. Accordingly, at 214, the engine model is used to interpolate from the adaptively learned actuator settings, and at 216, actuator settings for non-boundary conditions may be generated from the engine model. At 218, routine 200 includes updating and storing these settings in the memory of the controller. Routine 200 then ends.

In this way, the DLUT may be generated in parallel with learning and adapting actuator settings at speed-load boundary conditions. By using an interpolation model to determine actuator settings for non-boundary conditions, each speed-load point on the map may not be visited for data collection. Consequently, a lengthy data collection process may be reduced enabling a decrease in manufacturing costs. By controlling engine settings, such as spark timing, valve timing, and/or throttle position as a function of at least engine speed and/or load, a desired output may be achieved. For a given speed-load point at which no adaptive learning was explicitly done, actuator settings may be provided via a dynamic node look-up table (which is described further below), where the dynamic node look-up table is based on adaptive learned data during previous engine operation at another speed-load point. For example, the other speed-load point may be a boundary (e.g., minimum speed, minimum load, maximum speed, and/or maximum load) condition. In one example operation, the adaptive learning may be achieved by determining actual fuel economy for a given speed-load point and adaptively adjusting the settings at this speed-load point to maximize the fuel economy.

It will be appreciated that while the above example routine includes only learning actuator settings when boundary conditions randomly occur during normal engine operation, an engine in a hybrid vehicle may be commanded by the controller to visit boundary points on the speed-load map to enable adaptive learning.

It will also be appreciated that while the above example routine describes generating the DLUT from interpolating points between boundary conditions, other examples may include extrapolating the data. For example, boundary conditions may be extrapolated to non-boundary conditions. Henceforth, interpolation of data may be used interchangeably with extrapolation of data in the present disclosure.

FIG. 3 depicts an example routine 300 for using the DLUT generated in routine 200 at engine operating conditions that are away from the boundaries of the engine speed-load map. Specifically, actuator settings for speed-load combinations away from the boundary of the speed-load map may be selected from the DLUT to provide desired outputs such as reduced BSFC, compliant emissions, etc.

At 302, routine 300 may confirm if the current engine load and speed (e.g. determined at 204) are non-boundary conditions at the engine speed-load map. For example, non-boundary conditions may include any speeds and loads other than the speeds and loads at the boundaries of the speed-load map e.g., minimum speed, minimum load, maximum speed, and/or maximum load. If current operating conditions are not non-boundary conditions, the routine may end. Else, routine 300 continues to 304 to determine if the DLUT is ready for reference. In one example, sufficient initial engine operation may have occurred at boundary conditions to generate actuator settings for engine conditions within the speed-load boundaries in the DLUT. In another example, the engine may be in initial operation wherein boundary conditions may not have been experienced to generate actuator settings from adaptively learned data. Accordingly, if the DLUT is not ready to be referred to, routine 300 continues to 306 to continue engine operation with preprogrammed actuator settings. Else, at 308, the DLUT may be referred to for establishing engine settings at the determined engine speed and/or load. The actuator settings for the determined engine speed and/or load may be settings that provide a desired output such as reduced BSFC, improved torque, etc. At 310, the determined actuator settings may be applied to enable enhanced engine operation.

Thus, the DLUT may generate one or more engine settings based on adaptively learned settings for those same parameters at other engine speed and load conditions different from the determined engine speed and engine load. The other engine speed and engine load conditions may be boundary speed-load conditions at an edge of the look-up table, or an edge of a speed-load operating map stored in the controller of the vehicle. Therefore, during a first operating condition when the engine is operating at a boundary point of the speed-load map, the settings may be adaptively updated in the look-up table. Then, during a second, later, operating condition away from all boundary points, the settings output from the look-up table at the non-boundary condition speed-load point may be based on not only the data stored in the look-up table for that speed-load point, but also the adaptively updated data stored at the boundary speed-load point and an engine model. The engine model may be a dynamic model of the engine.

In this way, the DLUT approach can provide improved actuator settings once non-boundary speed-load points are actually encountered, without necessarily requiring adaptive learning at the non-boundary speed-load points. Therefore, complex and extensive engine mapping processes may be reduced.

Thus, a method for an engine may comprise learning a first set of engine settings at boundary conditions of a speed-load map, generating a dynamic node look-up table (DLUT) based on the learned settings, and determining a second set of engine settings for operation at non-boundary conditions of the speed-load map from the DLUT. Herein, the boundary conditions of the engine speed-load map may include one of minimum speed at any engine load, maximum speed at any engine load, minimum load at any engine speed, and maximum load at any engine speed, or minimum BSFC. The boundary conditions may provide a sparse sample of the speed-load map. Further, non-boundary conditions of the speed-load may include all speed-load conditions other than the boundary conditions of the engine load-speed map.

In order to illustrate the embodiment of the present disclosure, an indirect adaptive control problem is formulated below. Parameter estimation and model inversion methods for implementing the adaptive control are also presented. The adaptive control is applied to a nonlinear model of a naturally aspirated engine to demonstrate the validity of the algorithm used in the adaptive control. The algorithm in the adaptive control tracks a desired target output (e.g. engine load, CA50) and optimizes BSFC at boundary engine speed-load points. Further, a model structure of the DLUT is presented below which uses a collection of linear models centered at various speed-load points, such as the boundary speed-load points, to model engine behavior. Additionally, steady-state engine settings for speed-load points not explicitly visited by the adaptive control may be extracted from transient data learned at speed-load points at boundary conditions.

Figure 4:
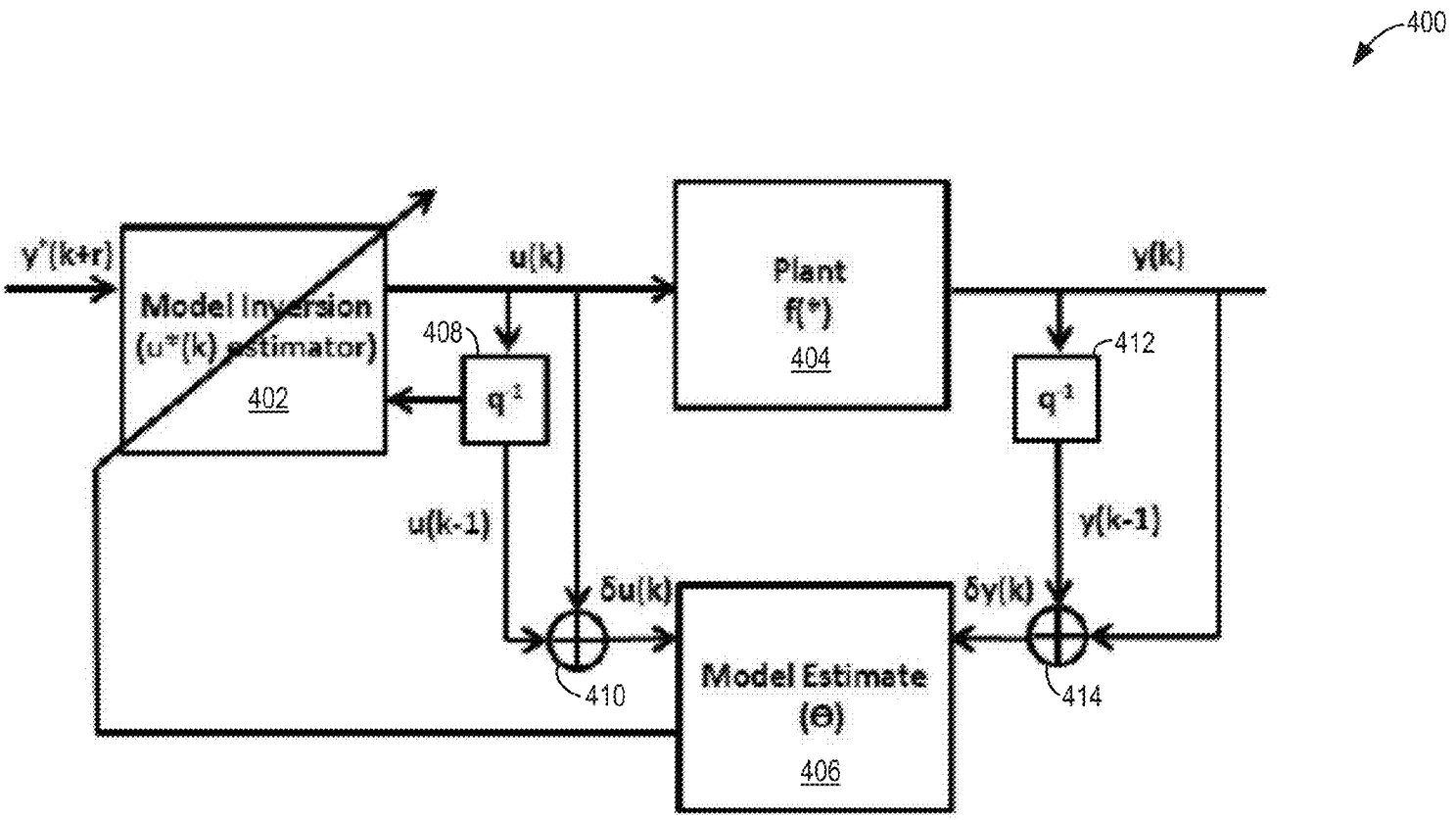
FIG. 4 is an example control system of the incremental adaptive model, according to the present disclosure.

Turning now to FIG. 4, it shows an example indirect adaptive control model 400 for implementing the adaptive control and learning an output y(k). Adaptive control model 400 may be an example architecture of an incremental adaptive model predictive control framework. Herein, a desired output y*(k+r) may be fed into model inversion estimator 402 which adjusts input u(k) that is applied to plant f(*) 404. Plant f(*) 404 may produce an output y(k). Disturbances in inputs between a current input and a previous input may be determined at a first comparator 410 as an input perturbation δu(k). Information about a previous input u(k−1) may be generated at 408. Similarly, information about a previous output y(k−1) may be determined at 412 and compared to current output y(k) at a second comparator 414 to determine output perturbation δy(k). Each of the input perturbation δu(k) and output perturbation δy(k) may be fed to model estimate 406. As such, model estimate 406 may use these perturbations to transmit an adjustment based on feedback to model inversion estimator 402.

Additional details about the adaptive control model will be clarified further below in an example adaptive control problem formulation, an example model estimation, and an example model inversion.

The adaptive control problem formulation can be described as follows. First, a nonlinear system may be considered:

$$y(k)=f(u(k-r), \ldots, u(k-n), y(k-1), \ldots, y(k-n)) \tag{1}$$

where n is the system order, r≤n is the relative degree, $y(k)\in\mathbb{R}^{l_y}$ is the output, $u(k)\in\mathbb{R}^{l_u}$ is the input, $f: \mathbb{R}^{l_u}\rightarrow\mathbb{R}^{l_y}$ is the plant, and $y^*(k)\in\mathbb{R}^{l_y}$ is the desired output. Furthermore, the magnitude of u(k) may be bounded such that $\mu_i^-\leq u_i(k)\leq\mu_i^+$ for i=1, . . . , $l_u$ and the transition rate is bounded such that $\|u_i(k)-u_i(k-1)\|\leq\xi_i$ for i=1, . . . , $l_u$.

Next, small perturbations about an operating point u(k), y(k) may be considered:

$$\delta y(k)\triangleq y(k)-y(k-1), \tag{2}$$

$$\delta u(k)\triangleq u(k)-u(k-1), \tag{3}$$

such that small perturbations may be written as:

$$\delta y(k)=\theta\varphi(k)+\beta_r^{\delta}u(k-r), \tag{4}$$

where $\theta\in\mathbb{R}^{l_y\times l[(n-r)l_u+nl_y]}$ are model parameters and $$\phi(k)=\begin{bmatrix}\delta u(k-r-1)\\ \vdots\\ \delta u(k-n)\\ \delta y(k-1)\\ \vdots\\ \delta y(k-n)\end{bmatrix}\in\mathbb{R}^{(n-r)l_u+nl_y}. \tag{5}$$

A goal of the present disclosure is to determine an ideal control input u*(k−r) which may yield ideal outputs $$y^*(k)=f(u^*(k-r), u(k-r-1), \ldots, u(k-n), \tag{6}$$

$$y(k-1), \ldots, y(k-n)), \tag{7}$$

$$\delta y^*(k)=\theta^*\varphi(k)+\beta_r^*\delta u^*(k-r), \tag{8}$$

where $$\delta y^*(k)=y^*(k)-y(k-1), \tag{9}$$

$$\delta u^*(k)=u^*(k)-u(k-1). \tag{10}$$

To solve for ideal control inputs, the known desired output y*(k) along with a model estimate $\hat{\theta}(k)$, and $\hat{\beta}_r(k)$, can be used. An estimate û(k) of the ideal controls u*(k) may be introduced, such that $\mu_i^-\leq\hat{\mu}_i(k)\leq\mu_i^+$ for i=1, . . . , $l_u$, $\|\hat{u}_i(k)-\hat{u}_i(k-1)\|\leq\xi_i$ for i=1, . . . , $l_u$, and $$\delta y^*(k)=\hat{\theta}(k)\varphi(k)+\hat{\beta}_r(k)\delta\hat{u}(k-r), \tag{11}$$

where $$\delta\hat{u}(k)\triangleq\hat{u}(k)-u(k-1). \tag{12}$$

Next, a model estimation using recursive least squares update is depicted. To estimate model parameters, equation (4) above may be written as follows:

$$\delta y(k)=\Theta(k)\Phi(k), \text{ where} \tag{13}$$

$$\hat{\Theta}(k)\triangleq\left[\hat{B}_r(k)\ \hat{\theta}(k)\right], \text{ and} \tag{14}$$

$$\Phi(k)=\begin{bmatrix}\delta u(k-r)\\ \phi(k)\end{bmatrix}, \tag{15}$$

Next, the model may be recursively updated by:

$$\hat{\Theta}(k)\triangleq\hat{\Theta}(k-1)+[\hat{\Theta}(k-1)\Phi(k-1)-\delta y(k-1)]\cdot[\Phi^T(k-1)P(k-1)\Phi(k-1)+\lambda]^{-1}\cdot\Phi^T(k-1)P(k-1), \tag{17}$$

where $P(0)\in\mathbb{R}^{[(n-r)l_u+nl_y]\times[(n-r)l_u+nl_y]}$ is a positive definite and λ∈(0, 1] is the forgetting factor.

and P(k) may be updated by $$P(k)\triangleq\lambda^{-1}P(k-1)-\lambda^{-1}P(k-1)\varphi(k-1) \tag{18}$$

$$\cdot[\Phi^T(k-1)P(k-1)\Phi(k-1)+\lambda]^{-1}\cdot\Phi^T(k-1)P(k-1). \tag{19}$$

Herein, P(0) may be initialized as $P(0)=\beta_1 I$, where $\beta_1>0$.

Next, the above model may be inverted using equality constrained quadratic programming. Before attempting to solve the model inversion problem, the outputs may be separated into two groups: those with explicit targets, and those to be minimized. Specifically, $\delta y_{1,w}(k)$ may be components of δy(k) with explicit targets, where $w\leq l_y$, and $\delta y_{w+1,l_y}$ may be the outputs to be minimized. Further $\hat{\beta}_{r,1,w}(k)$ may be assumed to include rows 1 through w of $\hat{\beta}_r(k)$, and $\hat{\theta}_{1,w}(k)$ may be assumed to include rows 1 through w of $\hat{\theta}(k)$. Furthermore, at time k, û(k) may be determined such that ‖y(k+r)−y*(k+r)‖ is small. A new term, z(k+r) may be defined as:

$$z(k+r)=\hat{\theta}(k+r)\varphi(k+r)+\hat{\beta}_r(k+r)\delta\hat{u}(k)-\delta y^*(k+r). \tag{20}$$

Equation (20) is equation (11) propagated r steps into the future. If Θ(k)−Θ(k−1) is assumed to be small, equation (20) may be rewritten as:

$$\hat{z}(k+r)=\hat{\theta}(k)\varphi(k+r)+\hat{\beta}_r(k)\delta\hat{u}(k)-\delta y^*(k+r). \tag{21}$$

Further, û(k) may be determined by minimizing the cost function as follows:

$$J(\delta\hat{u}(k))=\hat{z}_{w+1,l_y}^T(k+r)\hat{z}_{w+1,l_y}(k+r), \tag{22}$$

which may be subject to $$R(k)C(k)\delta\hat{u}(k)\leq D(k), \tag{23}$$

where, $R(k)\in\mathbb{R}^{2(l_u+w)}$ is a positive semi-definite control penalty, and $$C(k)=\begin{bmatrix}I_{l_u}\\ -I_{l_u}\\ \hat{\beta}_{r,1,w}\\ -\hat{\beta}_{r,1,w}\end{bmatrix}\in\mathbb{R}^{2(l_u+w)\times l_u},$$

$$D(k)=\left[\mu_1^+-\mu_1(k-1)\ \ldots\ \mu_{l_u}^+-u_{l_u}(k-1)-\mu_1^--u_1(k-1)\ \ldots\ -\mu_{l_u}^--u_{l_u}(k-1)(1+\rho)y_{1,w}^*(k+r)-\hat{\theta}_{1,w}\phi(k)-(1-\rho)y_{1,w}^*(k+r)+\hat{\theta}_{1,w}\phi(k)\right]^T\in\mathbb{R}^{2(l_u+w)},$$

where $\rho\epsilon(0,1]$, is the target following a tolerance boundary. Equation (21) may be substituted into equation (22) to yield $$J(\delta\hat{u}(k))=\delta\hat{u}^T(k)\mathcal{A}(k)\delta\hat{u}(k)+\delta\hat{u}^T(k)\mathcal{B}(k)+\mathcal{C}(k),$$

where $$\mathcal{A}(k)\triangleq\hat{\beta}_{r,w+1,l_y}^T(k)\hat{\beta}_{r,w+1,l_y}(k), \tag{24}$$

$$\mathcal{B}(k)\triangleq-2\hat{\beta}_{r,w+1,l_y}^T(k)[\hat{\theta}_{w+1,l_y}(k)\varphi(k+r)-\delta y_{w+1,l_y}^*(k+r)], \tag{25}$$

$$\mathcal{C}(k)\triangleq\varphi^T(k+r)\hat{\theta}_{w+1,l_y}^T(k)\hat{\theta}_{w+1,l_y}(k)\varphi(k+r)-\varphi^T(k+r)\hat{\theta}_{w+1,l_y}^T(k)\delta y_{w+1,l_y}^*(k+r)-\delta y_{w+1,l_y}^{*T}(k+r)\hat{\theta}_{w+1,l_y}^T(k)+\delta y_{w+1,l_y}^{*T}(k+r)\delta y_{w+1,l_y}^*(k+r).$$

Next, if $\mathcal{A}^\dagger(k)$ is assumed to be a generalized inverse of $\mathcal{A}(k)$, then $$\delta\hat{u}_1(k)=-\frac{1}{2}\mathcal{A}^\dagger(k)\mathcal{B}(k) \tag{26}$$

may be the unconstrained minimizer of equation (22). Therefore, the constrained solution of equation (22) subject to equation (23) may be found by solving the linear system:

$$\begin{bmatrix}\mathcal{A}(k) & C^T(k)\\ C(k) & 0\end{bmatrix}\begin{bmatrix}\delta u_2(k)\\ \lambda_L\end{bmatrix}=\begin{bmatrix}\mathcal{B}(k)\\ \mathcal{D}(k)\end{bmatrix}, \tag{27}$$

where, $\lambda_L\epsilon\mathbb{R}^{l_u}$ are the Lagrange multipliers, $\delta u_2(k)$ are the constrained controls, and $$\begin{bmatrix}\delta u_2(k)\\ \lambda_L\end{bmatrix}=\begin{bmatrix}\mathcal{A}(k) & C^TR(k)\\ R(k)C & 0\end{bmatrix}^\dagger\begin{bmatrix}\mathcal{B}(k)\\ \mathcal{D}\end{bmatrix}. \tag{28}$$

The matrix R(k) may be chosen using the algorithm:

Let $x(k)=\mathcal{C}(k)\delta\hat{u}_1(k)$.

Step 1: Compute equation (26)

Step 2: For i=1, . . . , $2(l_u+w)$, if $x_i(k)>D(k)_i$, then $R_{i,i}(k)=1$,

Step 3: Compute equation (28)

Step 4: For i=1, . . . , $l_u$, if $|\delta\hat{u}_{2,i}(k)|>\xi_i$, then $\delta u_i(k)=\mathrm{sgn}(\delta u_{2,i}(k))\xi_i$, if $|\delta\hat{u}_{2,i}(k)|<\xi_i$, then $\delta u_i(k)=\mathrm{sgn}(\delta_{2,i}(k))\xi_i$.

To demonstrate the above adaptive control, in one example a model of a naturally aspirated engine may be used. Herein, the engine may include actuators such as throttle, spark, intake cam, and exhaust cams such that actuator inputs may be throttle position, spark timing, intake cam timing, and exhaust cam timing. Further, engine load, CA50, and BSFC may be engine outputs. FIG. 5 illustrates map 500 depicting variations in throttle position, spark timing, intake cam timing, and exhaust cam timing to command three specific engine load points of 0.8, 0.5, and 0.2 bar, each at an engine speed of 700 RPM. Thus, boundary load points of 0.8, 0.5, and 0.2 bar may be visited while at a minimum engine speed of 700 RPM. These load points may be commanded while maintaining a CA50 of 9.07 and reducing BSFC. FIGS. 6, 7, and 8 portray the three outputs as generated by the variations in actuator inputs of FIG. 5.

As will be observed in FIG. 5, map 500 portrays gathered data on the x-axis along with exhaust cam timing at plot 502, intake cam timing at plot 504, spark timing at plot 506, and throttle position at plot 508. Meanwhile, FIG. 6 depicts map 600 showing gathered data on the x-axis and engine load on the y-axis. Map 600 includes plot 606 (dashed line) for the target load, plots 604 and 608 showing error boundaries, and plot 602 depicting the variations in load with changes in actuator settings. As will be observed, target loads commanded are 0.8, 0.5, and 0.2 (plot 606) and as actuator settings are varied, the actual load (plot 602) follows and eventually attains the target load within error boundaries.

For example, between data points 0 and 200, throttle is increased in map 500 (plot 508) to increase air flow and enable the relatively higher engine load of 0.8 (plot 602). Simultaneously, intake cam timing (plot 504) may be retarded and exhaust cam timing may be advanced (plot 502). By adjusting cam timings as shown, valve overlap may be reduced allowing sufficient torque to be produced at lower engine speeds (e.g. 700 RPM). Accordingly, by adaptively modifying the actuator settings, the desired engine load of 0.8 may be achieved while simultaneously minimizing BSFC.

Between data points 200 to about 350, throttle may be decreased (plot 508 in map 500) and a spark retard may be applied at the same time (plot 506 of map 500) to reduce torque for the lower target engine load of 0.5. Exhaust cam timing (plot 502) may also be retarded between data points 200 to about 400 while intake cam timing is advanced (plot 506). In response to these modifications in actuator settings, engine load drops from 0.8 to 0.5 (plot 602 in map 600) between data points 200 to about 350 in FIG. 6. Next, prior to data point 400, the target engine load of 0.2 may be achieved by applying a spark retard, and reducing torque, at about data point 370 (plot 506). Further, throttle may be retained at its lower setting to reduce air flow, and the adjustments to exhaust and intake cam timings made at about data points 275 may be maintained. FIG. 7 shows map 700 illustrating gathered data on x-axis with CA50 along y-axis. Actuator settings may be adjusted to provide a desired burn ratio, e.g. CA50 of 9.07, as shown in map 700. Plot 708 depicts the variation in actual CA50 as actuator settings are varied in FIG. 5, plot 706 is the target CA50 (9.07), and plots 702 and 704 depict error boundaries on map 700. As can be observed from map 700, actual CA50 reaches the desired target CA50 of 9.07 around data point 500.

FIG. 8 portrays map 800 showing collected data on x-axis along with BSFC plotted on the y-axis. Similar to map 700 of FIG. 7, map 800 shows variations in BSFC (plot 802) as actuator settings are adjusted in FIG. 5 to provide a reduced BSFC at each load setting. As will be observed, the adaptive control may be able to navigate the actuator space to complete the command objectives. It will also be appreciated that the above described process is autonomous. In other words, no human interaction with the engine may be involved, and no explicit logic may be used to select actuator settings. The algorithm learns the load, CA50, BSFC, and other constraints in response to actuator changes and uses this information to converge to desired settings. Further, the actuators may be moved simultaneously from one step to another to meet all targets/constraints simultaneously. Additionally, the control may not be sequential and one actuator may be manipulated at a given time to achieve one constraint/target at the given time.

The data gathered in transient conditions for actuator settings for desired engine outputs such as burn ratio and fuel efficiency (e.g. BSFC) may be later used to extract steady state information. Next, input-output data from the adaptive control may be used in closed loop with an engine to identify a time-invariant dynamic node look-up table (DLUT). In a first example, the DLUT may be a collection of linear models wherein system output is the sum of the outputs of all models in response to weighted inputs. In a second example, the DLUT may be a collection of linear models wherein the system output is the sum of weighted outputs in response to weighted inputs, or the sum of weighted outputs in response to an input. The first example model may be used herein to compute steady-state characteristics of the engine for speed-load points not explicitly visited by the adaptive control earlier. In the following example, as will be described later, actuator settings for load points other than 0.8, 0.5, and 0.2 may be determined. In another example (not shown), engine speed points other than 700 RPM may be visited.

In one example, a $p^{th}$ order (DLUT) with nodes $G_i(q)\in\mathbb{R}(q)^{l_y\times l_u}$, located at $\gamma_i\in\mathbb{R}^d$, for i=1, . . . , p. The system output at time k and marker $v(k)\in\mathbb{R}^d$ may be $$y(k)=\Sigma_{i=1}^{p}G_i(q)\Gamma_i(k,v(k),\gamma_i)u(k), \tag{29}$$

where for i=1, . . . , p, $\Gamma_i(k, v(k), \gamma_i)\in\mathbb{R}^{l_u\times l_u}$ are the LUT trajectory matrices. The LUT trajectory matrix may be chosen to be a distance between a current location v(k) and the $i^{th}$ node of the LUT. It may be assumed that for i=1, . . . p, $\Gamma_i(k)$ is known, nonsingular, and bounded for all k. Furthermore, equation (29) may be rewritten as $$y(k)=\overline{G}(q)\overline{\Gamma}(k,\ v(k),\ \gamma_i(k))u(k),\ \text{where} \tag{30}$$

$$\overline{G}(q)=[G_1(q)\ \cdots\ G_p(q)]\in\mathbb{R}(q)^{l_u\times pl_u},\ \text{and} \tag{31}$$

$$\overline{\Gamma}(k,\ v(k),\ \gamma_i(k))=\begin{bmatrix}\Gamma_i(k,\ v(k),\ \gamma_i(k))\\ \vdots\\ \Gamma_p(k,\ v(k),\ \gamma_i(k))\end{bmatrix}\in\mathbb{R}^{l_u\times pl_u}. \tag{32}$$

The LUT trajectory matrix may be selected to be a distance between the current location v(k) in the LUT and each of the nodes $\gamma_i$, for i=1, . . . , p. The distance measures may be chosen such that $\Gamma_i(k, v(k), \gamma_i(k))$ is nonsingular. Specifically, being nonsingular may include a situation where each of the nodes in the LUT has an impact on the output y(k), for all v(k). Furthermore, the distance measures may be chosen such that nodes closest to v(k) have a greater impact on y(k) than nodes farther away:

$$\Gamma_i(k,\ v(k),\ \gamma_i(k))=\frac{e^{-\sigma_i|\gamma_i-v(k)|}}{\sum_{j=1}^{p}e^{-\sigma_j|\gamma_j-v(k)|}}I_{l_u}, \tag{33}$$

where for i=1, . . . , p, $\sigma_i$ is a positive, and $0<\Gamma_i(k, v(k), \gamma_i(k))\leq 1$ for all k.

The stability of DLUTs of the form shown by equation (30) along with boundedness assumptions on the LUT trajectory matrices may follow from linear systems theory. For example, fact 7.1 may assume that $\|u(k)\|<\delta$ for all k, where $\delta\in[0, \infty)$, $\overline{\Gamma}(k, v(k), \gamma_i(k))$ may be chosen as equation (33), and y(k) may be given by equation (30). If $\overline{G}(q)$ is asymptotically stable then $\|y(k)\|<\infty$ for all k. A proof for the above may be obtained as follows: output equation (30) may be rewritten as $y(k)=\overline{G}(q)U(k)$, where $U(k)=\overline{\Gamma}(k, v(k), \gamma_i(k))u(k)\in\mathbb{R}^{pl_u}$. Further, it may be shown that $\|U(k)\|<\infty$, for all k by noting that $$\|U(k)\|\leq\|\overline{\Gamma}(k,v(k),\gamma_i(k))u(k)\|\leq\|\overline{\Gamma}(k,v(k),\gamma_i(k))\|\|u(k)\|. \tag{34}$$

Since $\overline{\Gamma}(k, v(k), \gamma_i(k))$ is selected as equation (33), then $\|\overline{\Gamma}(k, v(k), \gamma_i(k))\|<\sqrt{p}$ so that $$\|U(k)\|<p\delta, \tag{35}$$

for all k. Therefore, from linear theory it may follow that since U(k) is bounded, if $\overline{G}(q)$ is asymptotically stable, then y(k) is also bounded.

Next, parameters of the nodes of the LUT may be identified. Consider equation (29) rewritten as:

$$y(k)=\Omega\Upsilon(k), \tag{36}$$

where $$\Omega(k)\triangleq[M_1\ \ldots\ M_nN_1\ \ldots\ N_n]\in\mathbb{R}^{l_y\times[n(pl_u+l_y)+pl_u]}, \tag{37}$$

and for j=0, . . . , n, $M_i\in\mathbb{R}^{l_y\times pl_u}$, for j=1, . . . , n, $N_i\in\mathbb{R}^{l_y\times l_y}$, and $$\Upsilon(k)=\begin{bmatrix}\Gamma(k,\ v(k),\ \gamma_i(k))u(k)\\ \vdots\\ \overline{\Gamma}(k-n,\ v(k-n),\ \gamma_i(k-n))u(k-n)\\ y(k)\\ \vdots\\ y(k-n)\end{bmatrix}\in\mathbb{R}^{n(pl_u+l_y)+pl_u}. \tag{38}$$

Ω may be updated using the recursive least squares update as follows:

$$\Omega(k)\triangleq\Omega(k-1)+[\Omega(k-1)\Upsilon(k-1)-\gamma(k-1)][\Upsilon^T(k-1)P(k-1)\Upsilon(k-1)+1]^{-1}\cdot\Upsilon^T(k-1)\Xi(k-1), \tag{39}$$

where $\Xi(k)\in\mathbb{R}^{n(pl_u+l_y)\times n(pl_u+l_y)}$ is updated by $$\Xi(k)\triangleq\Xi(k-1)-\Xi(k-1)\Upsilon(k-1)[\Upsilon^T(k-1)\Xi(k-1)\Upsilon(k-1)+1]^{-1}\cdot\Upsilon^T(k-1)\Xi(k-1). \tag{40}$$

Ξ(k) may be initialized as $\Xi(k)=\beta_1 I$, where $\beta_2>0$.

A numerical example is illustrated below based on input and output data generated earlier via the adaptive control. Engine load may be selected as a DLUT marker, e.g. $v(k)=y_1(k)$, and nodes may be centered at γ=[0.2 0.3 0.4 0.5 0.6 0.7 0.8]. Further, the model order may be n=5, and $\beta_2=0.1$.

FIG. 9 shows map 900 which illustrates a comparison between actual engine outputs and estimated engine outputs according to the DLUT model. Map 900 depicts actual engine load at plot 902, predicted estimate of engine load at plot 904, error between actual load and estimate of load at plot 906, actual CA50 at 908, predicted estimate of CA50 at plot 910, error between actual CA50 and predicted CA50 at plot 912, actual BSFC at plot 914, predicted BSFC at plot 916, and error between actual BSFC and predicted BSFC at plot 918. All the above plots are portrayed against number of data points along the x-axis. Plots in FIG. 9 are based on data collected via the adaptive control described in reference to FIGS. 4-8. As will be observed, the error between actual load and model predicted load, actual CA50 and model predicted CA50, and actual BSFC and model predicted BSFC is relatively low and most of the time around the value zero. Thus, the model may track actual engine dynamics well. However, at data point 400 for BSFC, a spike in the actual BSFC may correspond to a singularity in the model of the naturally aspirated engine, which is not captured in the DLUT.

Since the DLUT model is capable of tracking actual engine dynamics suitably, steady state engine settings may be extracted from the DLUT by considering steady state input $u(k)=u_{SS}$, and $\Gamma=\Gamma_{SS}$ for k>0, which may produce steady state output $y(k)=y_{SS}$ for $k>0$. A relationship between steady state inputs and outputs may be computed from equation (29) as follows $$y_{SS}=\overline{G}(1)\overline{\Gamma}u_{SS}, \tag{41}$$

then, assuming $$l_y \geq l_u, u_{SS}=(\overline{G}(1)\overline{\Gamma})^{\dagger}y_{SS} \tag{42}$$

where † may be the pseudo inverse and the estimate $\overline{G}(1,k)$ of $\overline{G}(1)$ may be obtained analytically from $\Omega(k)$ as follows:

$$\Omega_{SS}(k)=[I_{l_y}-\Sigma_{i-1}^{n}N(k)_i]^{-1}\Sigma_{i=1}^{n}M(k)_i, \tag{43}$$

then $$u_{SS}=[[I_{l_y}-\Sigma_{i-1}^{n}N(k)_i]^{-1}\Sigma_{i=1}^{n}M(k)_i\Gamma_{SS}]^{-1}y_{SS}. \tag{44}$$

The steady state model $\Omega_{SS}$ may be used to compute steady state actuator settings for speed-load points away from the boundary points. Specifically, during adaptive control, actuator settings may be learned and adapted at specific engine loads that may occur at a boundary. In the example described earlier, three engine loads 0.8, 0.5, and 0.2 at a minimum speed of 700 RPM were visited and actuator settings such as throttle, spark timing, intake cam timing, and exhaust cam timing were learned and adapted to produce outputs including CA50 and desired BSFC. The actuator settings may be adjusted to provide reduced BSFC and therefore, improved fuel efficiency. Based on the data gathered at these specific engine loads, the DLUT may be identified via point interpolation and used to compute steady state actuator settings for load points away from those visited earlier. Thus, actuator settings for load points other than 0.8, 0.5, and 0.2 may be extracted from the DLUT. Accordingly, actuator settings to provide engine loads of 0.7, 0.6, 0.4, and 0.3 may be extracted from the DLUT via using steady state model $\Omega_{SS}$. Steady state input $u_{SS}$ may be computed subjected to meeting desired targets (e.g. CA50, load, etc.) within 7% while reducing, e.g. minimizing, BSFC.

TABLE 1

| Target Load | Target CA50 | Throttle | Spark | Intake | Exhaust % |
|---|---|---|---|---|---|
| 0.7 | 9 | 69.72 | −9.13 | −33 | −4.600 |
| 0.6 | 9 | 39.82 | −14.14 | 12.47 | −21 |
| 0.4 | 9 | 3.58 | −19.80 | 25.31 | −21 |
| 0.3 | 9 | 16.09 | 0 | 0.78 | −2.36 |

In TABLE 1 above, $u_{SS}$ is depicted for the boundary points not explicitly visited earlier. Herein, $u_{SS}$ maybe estimated using $\Omega_{SS}$. Further, the determined inputs have been tested on the naturally aspirated engine model used earlier to evaluate the accuracy of the DLUT model. The results are tabulated below in TABLE 2.

TABLE 2

| Estimated Load | Estimated CA50 | Estimated BSFC | Actual Load | Actual CA50 |
|---|---|---|---|---|
| 0.651 | 8.37 | 0 | 0.714 | 9.9 |
| 0.56 | 8.37 | 0 | 0.58 | 9.47 |
| 0.37 | 8.37 | 0 | 0.4 | 8.51 |
| 0.32 | 8.57 | 0 | 0.63 | 20 |

TABLE 2 shows estimated load, estimated CA50, and estimated BSFC for the computed steady state actuator settings determined from the DLUT. TABLE 2 also shows the actual load and actual CA50 when the determined actuator settings were used in the model of the naturally aspirated engine. As can be observed, the estimated load and CA50 are relatively close to the actual load and actual CA50, except for load point of 0.3. It should be noted that the load point of 0.3 (specifically, 0.32) corresponds to the singularity depicted on map 900 for BSFC (plots 914, 916, and 918) due to which reliable results were not obtained in this region.

TABLE 3

| Load | Actual BSFC | Optimal BSFC | % Error |
|---|---|---|---|
| 0.7 | 283.15 | 276 | 2.5 |
| 0.6 | 302.76 | 280 | 7.5 |
| 0.4 | 364.6 | 329 | 10.8 |
| 0.3 | 308 | 423 | n/a |

TABLE 3 compares the BSFC obtained from the steady state actuator settings determined based on the DLUT with optimal values for the same speed-load points. The error between the actual BSFC and optimal BSFC is relatively low particularly at higher loads. Thus, the developed DLUT model may be used to determine actuator settings that provide a desired output with sufficient accuracy.

As described earlier, an engine mapping process for modern gasoline turbocharged direct injection (GTDI) engines has become increasingly complex as the process requires extensive dynamometer data collection and post processing. Devices such as external exhaust gas recirculation (EGR), twin independent variable valve timing, wastegate, fuel rail pressure, start of injection, etc. may be used to vary engine parameters to improve emissions, fuel consumption and/or peak torque. In the present disclosure, a method for engine mapping includes visiting engine speed vs load points while varying systems parameters in the search for improved mean brake torque (MBT) and reduced brake specific fuel consumption (BSFC). In one example embodiment, a hybrid method may be applied that uses an indirect adaptive control to simultaneously meet targets and optimize for fuel economy. Herein, only a subset of all speed-load points may be commanded, and data may be gathered in transient engine operation. In parallel to the adaptive control, a dynamic node look-up table (DLUT) may be identified from the input and output data generated by the adaptive control. Further, the DLUT may be used to extract steady-state actuator settings for all points in the speed-load map that may not be explicitly visited by the adaptive control.

In this way, a hybrid adaptive control dynamic look-up table (DLUT) methodology may be applied for online powertrain optimization. The adaptive control may not explicitly visit each speed-load point on an engine map or look-up table to determine actuator settings for desired engine output. Accordingly, complicated data gathering and post processing may be decreased. By producing the DLUT in parallel with data gathering as the engine operates at boundary conditions, time spent on bench or on road for data gathering may be reduced. Overall, savings in time and expenses may be attained.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during operation of the engine:

learning a first set of engine actuator settings, including current positions or timings of engine actuators, while operating at boundary conditions of a speed-load map and adaptively adjusting the learned first set of engine actuator settings to provide a desired engine output;

generating a dynamic node look-up table (DLUT) based on the adaptively adjusted first set of engine actuator settings;

determining a second set of engine actuator settings for operation at non-boundary conditions of the speed-load map from the DLUT and not learning and adaptively adjusting the second set of engine actuator settings; and controlling engine actuators to the second set of engine actuator settings during operation of the engine at the non-boundary conditions.

2. The method of claim 1, wherein the boundary conditions of the speed-load map include one of minimum speed at any engine load, maximum speed at any engine load, minimum load at any engine speed, and maximum load at any engine speed and wherein the learning the first set of engine actuator settings is responsive to operating the engine at an engine speed and engine load that is at one of the boundary conditions of the speed-load map.

3. The method of claim 1, wherein the second set of engine actuator settings includes one or more of throttle position, spark timing, intake cam timing, and exhaust cam timing.

4. The method of claim 1, wherein the second set of engine actuator settings produces the desired engine output, the desired engine output including one or more of engine load, brake specific fuel consumption, and crank angle for 50% burn and wherein adaptively adjusting the learned first set of engine actuator settings to provide the desired engine output includes adjusting one or more of the engine actuators to adjust one or more engine actuator settings to achieve the desired engine output.

5. The method of claim 4, wherein the second set of engine actuator settings reduces the brake specific fuel consumption.

6. The method of claim 1, wherein the DLUT is generated by a collection of linear models, wherein generating the DLUT includes using the collection of linear models to interpolate from the learned and adaptively adjusted first set of engine actuator settings to determine the second set of engine actuator settings and storing the determined second set of engine actuator settings in the DLUT, and wherein the first set of engine actuator settings are learned from preprogrammed or previously learned engine actuator settings.

7. The method of claim 1, wherein the engine is a naturally aspirated engine and wherein determining the second set of engine actuator settings from the DLUT includes, in response to operating the engine at the non-boundary conditions of the speed-load map, interpolating between the adaptively adjusted first set of engine actuator settings at the boundary conditions to generate the second set of engine actuator settings at the non-boundary conditions.

8. The method of claim 1, where the generated DLUT includes adaptively learned engine actuator settings for engine speed and engine load values that are at the boundary conditions of the speed-load map and engine actuator settings that are not adaptively learned at the non-boundary conditions of the speed-load map, where the engine actuator settings that are not adaptively learned are determined and stored within the DLUT according to one or more engine models that use the adaptively learned engine actuator settings as inputs.

9. The method of claim 1, wherein adaptively adjusting the learned first set of engine actuator settings to provide the desired engine output includes adjusting two or more of the engine actuators to adjust two or more engine actuator settings to achieve the desired engine output, where adjusting the two or more engine actuators includes adjusting two or more of a throttle position of a throttle, spark timing of a spark plug, intake cam timing of an intake valve, exhaust cam timing of an exhaust valve, a position of an exhaust gas recirculation valve, and a position of a wastegate.

10. The method of claim 1, wherein learning the first set of engine actuator settings and adaptively adjusting the learned first set of engine actuator settings to provide the desired engine output includes commanding the engine to operate at engine speeds and engine loads that are at different boundary conditions of the speed-load map while varying the engine actuators to achieve a desired mean brake torque and reduced brake specific fuel consumption.

11. The method of claim 1, further comprising adaptively adjusting the learned first set of engine actuator settings in parallel with generating the DLUT based on the adaptively adjusted first set of engine actuator settings, as the engine operates at different boundary conditions of the speed-load map.

12. The method of claim 1, wherein adaptively adjusting the learned first set of engine actuator settings to provide the desired engine output includes simultaneously adjusting two or more engine actuators to achieve a desired engine load while simultaneously minimizing brake specific fuel consumption.

13. The method of claim 1, wherein adaptively adjusting the learned first set of engine actuator settings to provide the desired engine output includes simultaneously adjusting two or more engine actuators to simultaneously achieve each of a desired engine load, brake specific fuel consumption, and burn ratio.

14. A method for an engine, comprising:

during operation of the engine:

learning a first set of engine actuator settings, which include current positions or timings of engine actuators, while operating at an engine speed and engine load that are at boundary conditions of a speed-load map and adaptively adjusting the learned first set of engine actuator settings, via adjusting the positions or timings of the engine actuators, based on a desired engine output, the desired engine output including one or more of a desired burn ratio, brake specific fuel consumption, and mean brake torque;

generating a dynamic node look-up table (DLUT) based on the adapted settings, the DLUT including adaptively learned engine actuator settings for engine speed and engine load values that are at the boundary conditions of the speed-load map and engine actuator settings that are not adaptively learned at non-boundary conditions of the speed-load map;

determining a second set of engine actuator settings for operation at the non-boundary conditions of the speed-load map from the DLUT for which no learning and adaptive adjusting is conducted; and controlling engine actuators to the second set of engine actuator settings during operation of the engine at the non-boundary conditions.

15. The method of claim 14, wherein adaptively adjusting the learned first set of engine actuator settings to provide the desired engine output includes simultaneously adjusting two or more engine actuators to achieve a desired engine load while simultaneously minimizing brake specific fuel consumption.

* * * * *